United States Patent [19]

Cocker

[11] 4,387,917

[45] Jun. 14, 1983

[54] PANIC BOLT UNITS

[75] Inventor: Michael J. Cocker, Stockport, England

[73] Assignees: Peter George Legg; Melvyn Alan Tindall, both of Lancaster, England

[21] Appl. No.: 107,434

[22] Filed: Dec. 26, 1979

[51] Int. Cl.[3] ..... E05C 15/02

[52] U.S. Cl. ..... 292/40; 292/93

[58] Field of Search ..... 292/40, 39, 21, 336.3, 292/92, 93

[56] References Cited

U.S. PATENT DOCUMENTS

| | | | |
|---|---|---|---|
| 2,108,359 | 2/1938 | Accardi | 292/34 |
| 3,099,473 | 7/1963 | Pastva, Jr. | 292/218 X |

FOREIGN PATENT DOCUMENTS

| | | | |
|---|---|---|---|
| 303605 | 2/1955 | Switzerland | 292/34 |
| 483545 | 2/1970 | Switzerland | 292/34 |
| 24033 | of 1904 | United Kingdom | 292/93 |

*Primary Examiner*—Richard E. Moore

*Attorney, Agent, or Firm*—Norris & Bateman

[57] ABSTRACT

A door lock and release mechanism carried by a door and having a pair of oppositely directed locking bolts simultaneously movable to a release position by a door mounted operating bar. Provision is also made for moving the bolts to a locking position when the door is closed.

5 Claims, 7 Drawing Figures

PANIC BOLT UNITS

This invention relates to improvements in door locks and panic bolts release mechanism.

According to the invention a door lock and panic bolt release mechanism comprises a box section member housing two vertically sliding bolts formed in two parts adapted to move in opposite directions, a pair of U shaped slotted plates to which the parts of the bolts are respectively secured, pegs extending from the channel member and passing through the slots in the slotted plates, a T member mounted on pins projecting from the slotted plates, a square spindle engaging a square bore in the T member, a cam keyed on to the spindle and a lever engaging the cam and by which the latter is rotated by pressure on the lever to release the bolts from a door.

The invention will be described with reference to the accompanying drawings.

Figure 1:
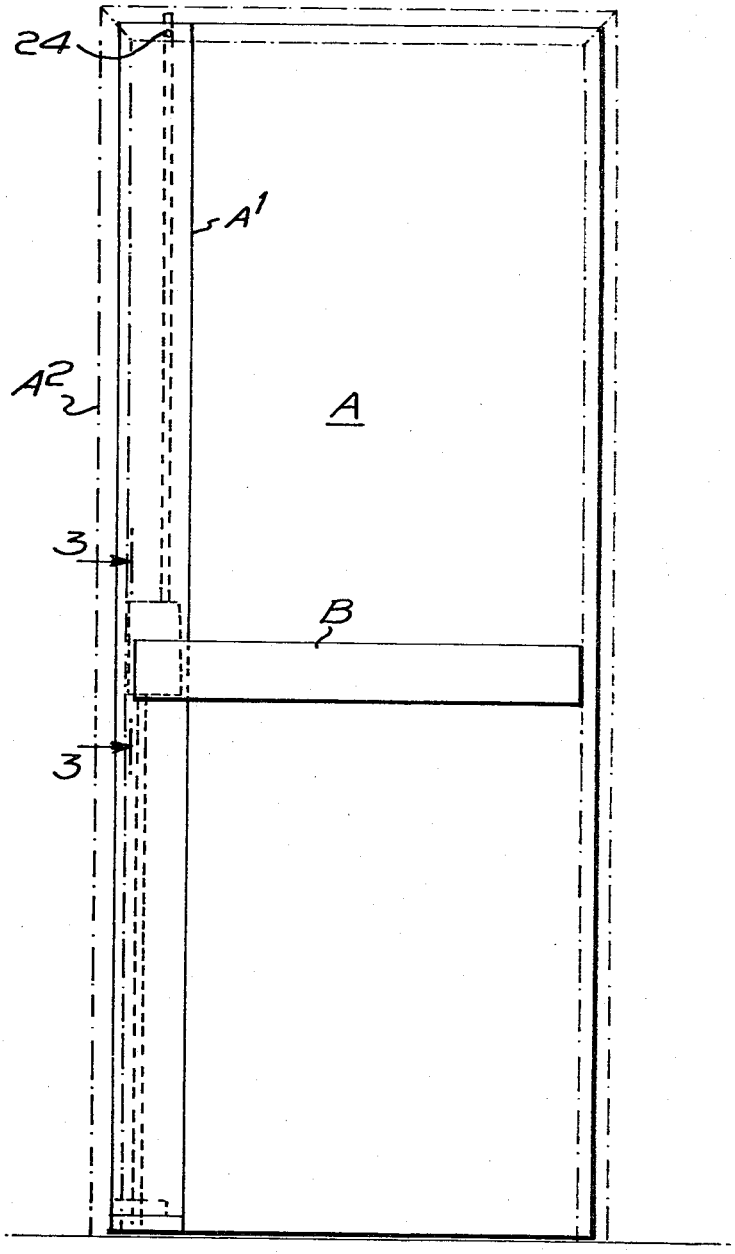
FIG. 1 is a front elevation of a door fitted with a panic bolt.

A door A is provided with a panic operating bar B.

The door A may be recessed along the closing edge to house the operating mechanism or the operating mechanism may be built on to the door and is enclosed in a box section or channel member A.

The operating mechanism housed in the channel member $A^1$ extends vertically of the closing edge of the door.

A pair of operating bolts 1,2 divided into two portions are connected at their adjacent ends to the ends of U shaped plates 3,4 respectively connected together by a T shaped member 5 pivoted on pins 6 to the plates 3,4.

The T shaped member 5 is formed with a leg having a square bore 7 extending there into to receive a square spindle 8 carrying at its opposite end a cam 9.

Figure 2:
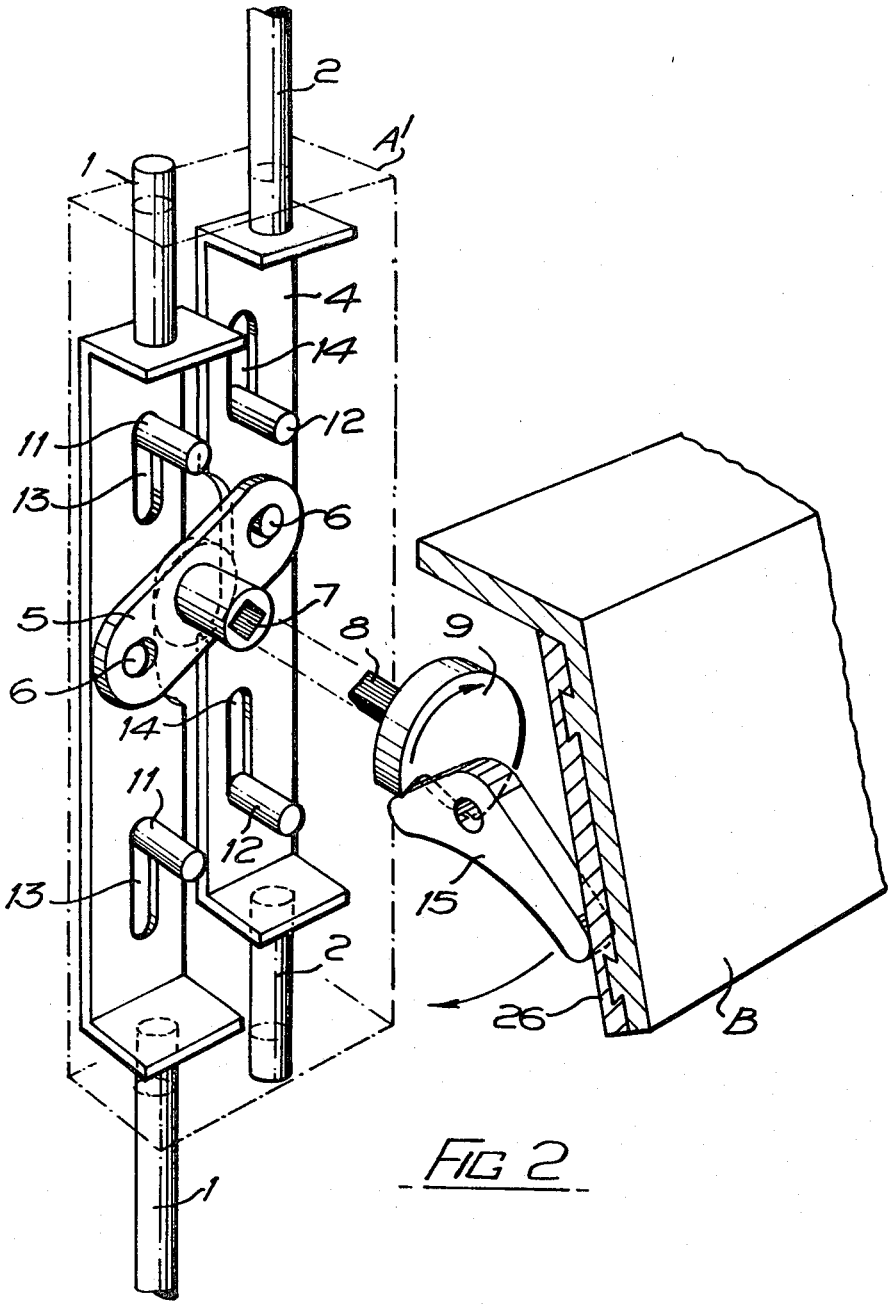
FIG. 2 is a perspective view of the operating mechanism partly in section.
Figure 3:
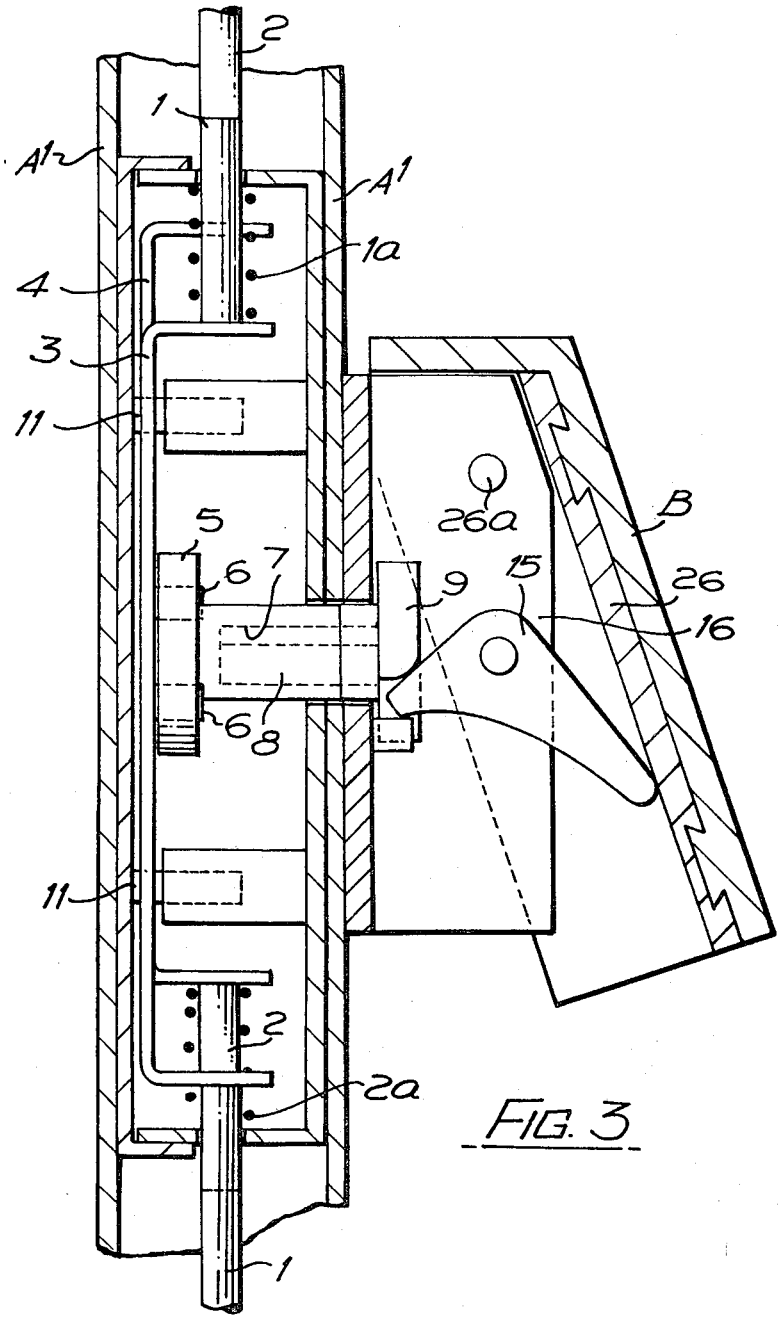
FIG. 3 is a section on line 3—3 FIG. 1.
Figure 4:
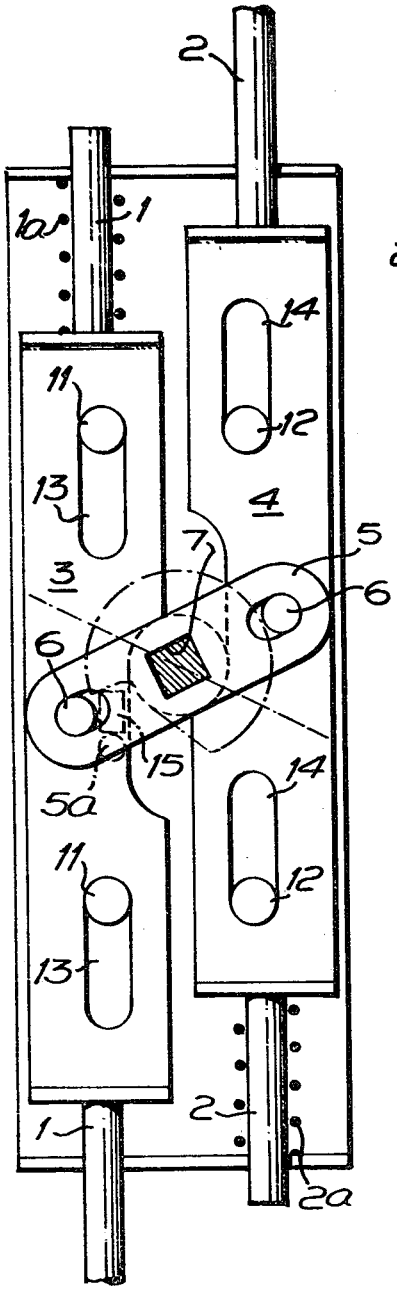
FIG. 4 is a section at right angles to FIG. 3.

The plates 3,4 are each mounted on two pegs 11,12 passing through slots 13,14 in the plates so that as the T member pivots from the position shown in FIG. 2 the plate 3 is moved upwards and with it the bolt 1 and the plate 4 is moved downwards and with it the bolt 2.

The upward movement of the bolt 1 releases the lower end from the door jamb and the downward movement of the bolt 2 is released from the upper end of the door jamb, A stop 5 a is provided to limit the movement of the T member 5.

The cam 9 is operated by a lever 15 pivoted on a plate 16 carried by the channel member $A^1$ and moves at 90° to the movement of the lever. Also pivoted on the plate 16 is the operating bar B. Thus pressure on the operating bar B actuates the lever 15 to rotate the cam 9 as shown by the arrow to release the bolts 1,2.

In order to reset the bar B the Bolt 2 locking the upper end of the door A and to reset the bolt 1 locking locking the bottom of the door each bolt has screwed thereon a small sleeve 17 formed with notches 18,19.

Figure 6:
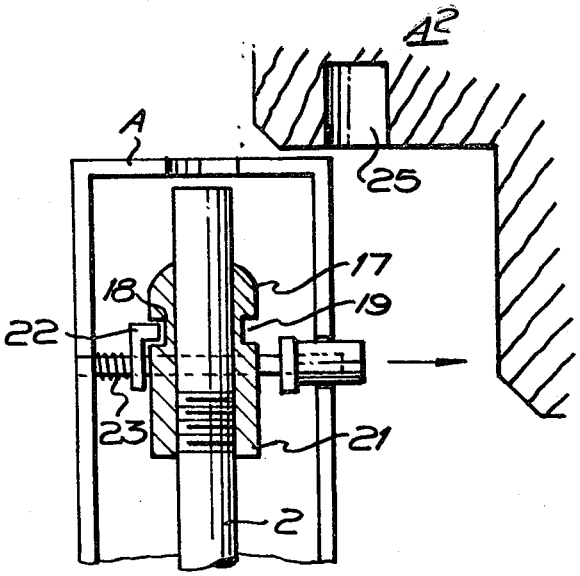
FIG. 6 is a detail view of the door about to close.

A spindle 21 passes transversely through the channel member $A^1$ and at one end supports a catch 22 loaded by a spring 23 (FIG. 6) and at the other end is form with a button 24. As the door A approaches the closed position the bolt 2 is arrested by the catch 22 engaging the notch 18 and as the door closes against the jamb $A^2$ on the door frame the push button 24 engages the jamb and moves the spindle 21 to release the catch 22 from the notch 18 thereby allowing the bolt 2 to enter a slot 25 in the jamb against the action of springs 1*a*, 2*a* to relock the door. A similar sleeve 17 is provided on the bolt to allow the bolt 1 to relock the bottom of the door.

The bar B is mounted to slide on a plate 26 for ease of installation which engages the lever 15, pivoted on a pin 26*a*. A similar mechanism may be provided at the hinge edge of the door to balance the movement of the bar B.

Figure 7:
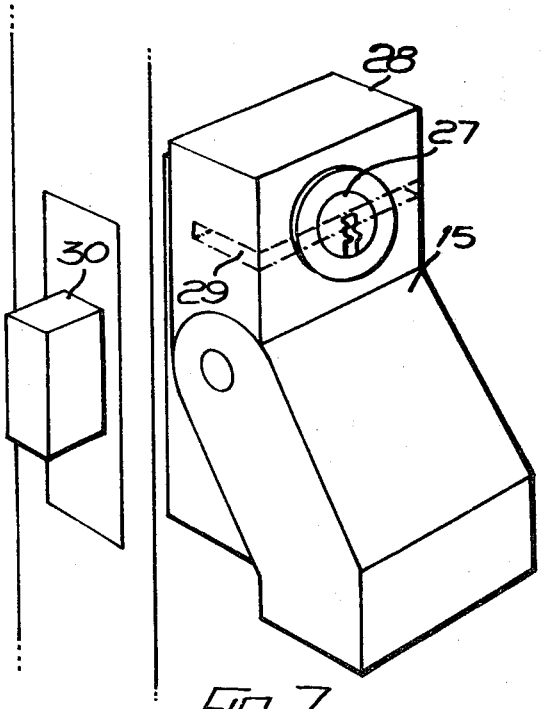
FIG. 7 is a perspective view of a door lock.
Figure 5:
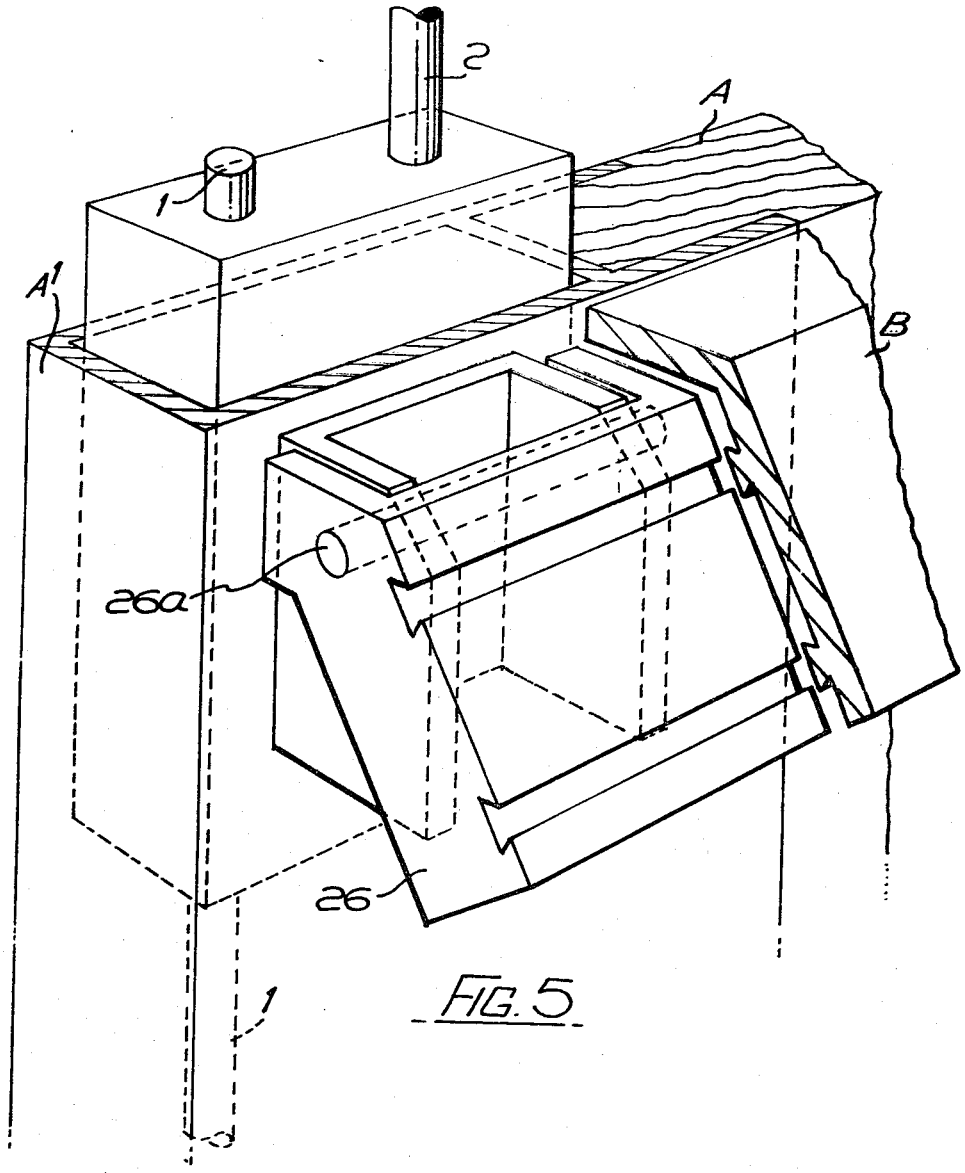
FIG. 5 is a perspective view of the operating mechanism on the door.

The mechanism may be employed to operate a door latch (FIG. 7) in which pressure on the lever 15 operates the T member to release a latch 30. By pressure from similar mechanism on the opposite side of the door with the cam 9 reversed a pull on the lever 15 will actuate the latch from the other side of the door. Where a lock 27 is fitted the turning of the key allows the lever 15 to be activated to free the door. Alternatively a card (not shown) may be employed instead of a key, to enter a slot 29 to operate a locking mechanism by a micro circuit to release the lever 15 to free the door.

What I claim is:

1. A door lock and panic bolt unit release mechanism comprising a box section member mounted in a door and housing two vertically sliding bolts adapted to move in opposite directions, a pair of U-shaped slotted plates to which the bolts are respectively secured, pegs extending from the box section member and passing through the slots in the slotted plates, a T-member on pins projecting from the slotted plates a spindle non-rotatably connected to the T-member, a cam onto the spindle, and a lever engaging the cam and by which the cam is rotated by pressure to release the bolts from a door.

2. A door lock and panic bolt release mechanism as in claim 1, in which the lever is actuated by a bar extending transversely of the door pressure on the bar operating the lever.

3. A door lock and panic bolt release mechanism as in claim 1, duplicated at the hinge edge of the door.

4. A door lock and panic bolt release mechanism as in anyone of the preceeding claims 1–3, in which the door is recessed to accommodate the box section member.

5. A door lock as in claim 1 in which a release mechanism is duplicated on both sides of the closing edge of the door.

* * * * *